US007784627B2

(12) United States Patent
Birkigt et al.

(10) Patent No.: US 7,784,627 B2
(45) **Date of Patent: *Aug. 31, 2010**

(54) DEVICE FOR SUSPENDING A RAIL, PARTICULARLY A RUNNING RAIL OF AN OVERHEAD CONVEYOR OR OF A LIFTING APPARATUS

(75) Inventors: Reinhard Birkigt, Herdecke (DE); Michael Buike, Hagen (DE); Klaus Enners, Wuppertal (DE); Stefan Fitzler, Iserlohn (DE); Udo Gersemsky, Herdecke (DE); Ingo Grassmann, Herdecke (DE); Sven Müller, Breckerfeld (DE); Klaus Nerger, Neukirchen-Vluyn (DE); Stefan Steinberg, Selm (DE); Rüdiger Ostholt, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 49 days.

This patent is subject to a terminal disclaimer.

(21) Appl. No.: 12/088,366

(22) PCT Filed: Aug. 4, 2006

(86) PCT No.: PCT/EP2006/065073

§ 371 (c)(1),
(2), (4) Date: Mar. 27, 2008

(87) PCT Pub. No.: WO2007/039338

PCT Pub. Date: Apr. 12, 2007

(65) Prior Publication Data

US 2008/0230503 A1 Sep. 25, 2008

(30) Foreign Application Priority Data

Oct. 1, 2005 (DE) ..... 10 2005 047 205

(51) Int. Cl.
*B66B 19/00* (2006.01)

(52) U.S. Cl. ..... 212/315; 104/94; 104/111

(58) Field of Classification Search ..... 212/315; 104/94, 111

See application file for complete search history.

(56) References Cited

U.S. PATENT DOCUMENTS 4,934,275 A * 6/1990 Miyazaki et al. ..... 104/91

(Continued)

FOREIGN PATENT DOCUMENTS

CA 2102585 5/1995

(Continued)

OTHER PUBLICATIONS

International Search Report and Written Opinion from corresponding Patent Cooperation Treaty Application No. PCT/EP06/65073, dated Nov. 30, 2006.

(Continued)

*Primary Examiner*—Thomas J. Brahan
(74) *Attorney, Agent, or Firm*—Van Dyke, Gardner, Linn & Burkhart, LLP

(57) ABSTRACT

A device for suspending a rail, particularly a running rail of an overhead conveyor or of a lifting apparatus, on a traveling mechanism or supporting framework with a traction element, which is fastened at one end to the rail. The traction element is passed through by a bolt, which is fastened to the rail via a fixing device. The traction element consists of a single part and comprises a lower borehole for the bolt and an upper borehole for fastening to the traveling mechanism or to the supporting framework.

20 Claims, 7 Drawing Sheets

U.S. PATENT DOCUMENTS

| | | | | |
|---|---|---|---|---|
| 5,357,868 | A | 10/1994 | Maas | |
| 5,598,785 | A | 2/1997 | Zaguroli, Jr. | |
| 5,957,057 | A | 9/1999 | Nakamura et al. | |
| 6,058,849 | A | 5/2000 | Ostholt et al. | |
| 6,138,574 | A | 10/2000 | Zaguroli, Jr. | |
| 6,196,133 | B1 | 3/2001 | Fitzler et al. | |
| 6,991,094 | B2 * | 1/2006 | Frost | 198/853 |
| 7,503,263 | B2 * | 3/2009 | Birkigt et al. | 104/111 |
| 2004/0238473 | A1 | 12/2004 | McKay | |
| 2007/0186800 | A1 | 8/2007 | Birkigt et al. | |
| 2008/0041806 | A1 | 2/2008 | Birkigt et al. | |

FOREIGN PATENT DOCUMENTS

| | | | |
|---|---|---|---|
| DE | 1096288 | A | 12/1960 |
| DE | 19753169 | A1 | 6/1999 |
| DE | 10115565 | A1 | 9/2002 |
| EP | 0 567 295 | A1 | 10/1993 |
| EP | 0 656 312 | A1 | 6/1995 |
| EP | 0860394 | A2 | 2/1998 |
| EP | 0 845 435 | A1 | 6/1998 |
| JP | 56 155186 | A | 12/1981 |
| WO | 03/101878 | A1 | 12/2003 |

OTHER PUBLICATIONS

Mar. 2000 Prospectus entitled "Crane Construction Kit KBK Classic and KBK Ergo" from Demag Cranes & Components GmbH of Wetter, Germany, the assignee of the present application.

Photograph of suspension system by Ingersoll Rand Zimmerman (dated 2005; exact date unknown).

Office Action mailed Jul. 29, 2008, in U.S. Appl. No. 11/537,116, filed Sep. 29, 2006, for Device for Suspending a Rail of an Overhead Conveyor or a Hoisting Machine, for Applicant Reinhard Birkigt.

Response filed Nov. 24, 2008, to Office Action mailed Jul. 29, 2008, in U.S. Appl. No. 11/537,116, filed Sep. 29, 2006, for Device for Suspending a Rail of an Overhead Conveyor or a Hoisting Machine, for Applicant Reinhard Birkigt.

Office Action, dated Sep. 22, 2009 for U.S. Appl. No. 11/537,186, filed Sep. 29, 2006.

Response to Office Action, dated Nov. 30, 2009, for U.S. Appl. No. 11/537,186, filed Sep. 29, 2006.

Response to Notice of Non-Compliant Amendment, dated Feb. 24, 2010, for U.S. Appl. No. 11/537,186, filed Sep. 29, 2006.

* cited by examiner

DEVICE FOR SUSPENDING A RAIL, PARTICULARLY A RUNNING RAIL OF AN OVERHEAD CONVEYOR OR OF A LIFTING APPARATUS

CROSS REFERENCE TO RELATED APPLICATION

This application claims the priority benefits of International Application No. PCT/EP2006/065073, filed on Aug. 4, 2006, which is hereby incorporated herein by reference in its entirety.

FIELD OF THE INVENTION

The invention pertains to a device for suspending a rail, especially a travel rail of an overhead conveyor or a hoisting machine, from a traversing gear or supporting structure with a tension element, being secured by one end to the rail, while a bolt passes through the tension element and is received by a fixing device that is secured to the rail.

BACKGROUND OF THE INVENTION

From the prospectus (March 2000 edition) entitled "Crane Construction Kit KBK classic and KBK ergo" of the firm Demag Cranes & Components GmbH, Wetter, Germany, there is known a crane construction kit system with c-shaped and I-shaped rails which are open at the bottom, by which one can implement different kinds of constructions, such as monorail telphers, or single and double-beam overhead cranes. In each case, the rails are suspended from support structures, other rails, or traversing gears which run into other rails. These suspension systems have a pendulum type design, which ensures that the rails align themselves and thus come into a state of equilibrium, i.e., no significant bending load occurs in the tension element. The pendulum suspension occurs through ball and socket bearings, having steel ball segments and mating ball cups with plastic slide shells. The ball segments are fastened to the end of a compound tension element. Thus, the tension element includes (looking down from above) a lug to fasten the tension element to the supporting structures, other rails or traversing gears, and a shaft joined to it as a single piece, to which the ball segment is screwed and secured.

In a suspension system of c-shaped rails open at the bottom, with a web broadening out toward the top and arranged at the top side of the rail, preferably a y-shaped or T-shaped web, the fixing device includes two identical fixing parts. These fixing parts are formed as sheet metal parts in such a way that, after being fitted together and held by screws, the broadening web of the rail is clamped in the lower region and the ball cup is accommodated in the upper region, while the tension element is passed through an opening.

This type of suspension system has been popular for many years and is easily installed on any given portion of a rail, since the fixing parts are fitted together there and tightened together by the screws for a clamping against the rail.

From U.S. Patent Publication No. 2004/0238473 A1 there is known a crane arrangement in which a bridge girder can run on parallel rails which are spaced apart from each other by means of traversing gears arranged at its ends. The bridge girder is clamped together with the traversing gears by u-shaped stirrups, open at the bottom, which enclose the bridge girder. Between the stirrups and the traversing gears there are vertically oriented ball and socket bearings, so that the traversing gears can turn 360 degrees about a vertical axis relative to the bridge girder and can also be tilted laterally. The ball and socket bearings used have balls made of steel and cups of nylon.

In these ball and socket elements, the ball of the tension element must be introduced into the ball cup, while the shaft passes through the central bore of the cup. Therefore, the tension elements are made of at least two parts, namely, a tension rod and a ball head, which are fastened to each other after being assembled with the tension rod introduced through the central bore in the ball cup. One often uses ball nuts that are screwed onto the tension rod. This connection is secured, for example, by a cotter pin.

The ball cups can be ruined by improper use or deficient maintenance. This results in increased friction between ball head and ball cup. In the case of two-part tension elements made from tension rod and ball head, the element securing the connection between tension rod and ball head is then overloaded. This can result in collapse of the bridge girder. The securing element can also fail, which likewise results in a failure of the suspension. Furthermore, the tension rod is weakened by the notch effect of the thread placed on it. Moreover, when the load is removed from the rail, the rail lifts slightly and the ball cup is pulled off from the ball head. When the rail is then placed under load, there is an abrupt loading of the ball and socket joint. This also has to be factored into the design.

Moreover, suspension systems are known from the firm Ingersoll Rand Zimmerman, of Milwaukee, Wis., for c-shaped crane rail open at the bottom, having a y-shaped web broadening at the top and arranged on the top side of the rail for a fixing unit made of two identical fixing parts. This suspension system has a tension element consisting essentially of a tension rod and a lug fastened thereto. The tension rod here is mounted in the lug by its lower end, able to turn about a vertical axis, and secured rigidly to a supporting structure at its upper end. The lug, in turn, is fastened by its bore to a bolt, extending in the lengthwise direction of the rail. Thus, the tension element can swivel transversely to the rail and can turn about a vertical axis. The tension element is rigid in and against the lengthwise direction of the rail. Furthermore, the bolt for the lug is mounted in the fixing parts. The fixing parts can swivel about the bolt and restrain a y-shaped web by means of screws. The screws for this are led through a borehole in the web.

Also known from the firm Krantechnik Müller, Lebach, Germany, are additional suspension systems for the above-described c-shaped crane rails, open at the bottom, with the y-shaped broadening web. These consist essentially of a two-piece tension element, two pivoting bearings, a bolt, a bracket and a fixing device. The tension element consists of an upper and lower piece, which are screwed together. The tension element has one borehole each at its upper and its lower end, each of which receive a pivoting bearing with a ball cup and a ball head. The lower ball head is connected to the bolt, which extends in the lengthwise direction of the rail. The ends of the bolt extending in front of and behind the ball head are each secured in pivoting manner and by a cotter pin in the legs of a u-shaped bracket, open at the top, whose web extending below and at a distance from the bolt is accommodated by the fixing device with the y-shaped web. For this, the fixing device in turn consists of two identical fixing parts, which are fastened by screws to clamp against the web of the bracket and the y-shaped web of the rail. The tension element again consists of multiple pieces.

SUMMARY OF THE INVENTION

According to an aspect of the invention, in a device for suspending a rail, especially a travel rail of an overhead conveyor or a hoisting machine, from a traversing gear or supporting structure with a tension element, being secured by one end to the rail, while a bolt passes through the tension element and is received by a fixing device that is secured to the rail, one achieves a secure construction as well as a long service life and a low structural height in that the tension element is one piece and exhibits a lower borehole for the bolt as well as an upper borehole in order to fasten it to the traversing gear or supporting structure. The one-piece tension element directly increases safety, as there are no joints within the tension element that may fail. Furthermore the tension element can be produced in an especially simple manner. Placing two boreholes in the tension element most easily provides mounting points for the tension element.

In one embodiment, the tension element is a flat connection rod-like bracket.

The bolt may be fastened to the tension element by means of a ball-shaped joint, especially a pivoting bearing. In this way, the bolt can be directly connected to the fixing device and the structural height of the overall suspension is minimized. This direct connection increases the safety of the suspension. The use of a pivoting bearing makes it possible to achieve long service life. The design is simplified, in that customary, industrially manufactured pivoting bearings can be used, which are relatively low in wear and tear.

Pivoting bearings are structural units that have an outer race, in which an inner race is mounted. The inner race has a cylindrical bore to accommodate a bolt without twisting, and a spherical outer slide track to form the ball head. This outer slide track engages with a hollow spherical inner slide track of the outer race, which is inserted by its cylindrical envelope surface in a bore without twisting. Both the outer slide track and the inner slide track can be made of steel and stand directly against each other. In this case, a supply of lubricant is most often provided for. In the present application, one uses pivoting bearings that have a slide layer or a slide ring, such as one of plastic or polytetrafluoroethylene (PTFE or Teflon®), between the inner and outer race. This slide ring is then secured to the outer race and the inner race slides in the slide ring. In another design, the outer race as a separate part can be omitted and its function is taken over by the tension element. The inner race in this case is inserted transversely into the broadened bore in the tension element and turned through ninety degrees in the bore to take up its working position. After this, the broad portion of the bore and the gap between inner race and bore is filled with a plastic, which hardens to form the slide ring. Standardized and industrially manufactured radial pivoting bearings, such as those per DIN ISO 12240, which are jointed and enable three-dimensional adjustments, may be used.

The structural height may be further minimized in that the bolt and the tension element are at least partly recessed into the fixing device, looking in the suspension direction. Preferably, the entire bolt is completely recessed into the fixing device, looking in the suspension direction. This also facilitates a secure fastening of the bolt in the fixing device.

In order to achieve a recessing of the tension element and the pivoting bearing in the fixing device, the fixing device may have an intermediate space, looking at right angles to the direction of suspension and looking at right angles to the bolt, so that the fixing device has a u-shaped form open at the top, and the tension element or the tension element and the bolt protrude into the intermediate space. In a preferred embodiment, the bolt is oriented with its lengthwise dimension parallel to the lengthwise direction of the rail.

A secure connection of the bolt in the fixing device and thus a direct flow of force may be achieved in that the bolt is held free of torsion in bores in the fixing device by its ends protruding at either side beyond the pivoting bearing. In this way, only the pivoting bearing is under stress due to the movements of the suspension system.

In one embodiment, the fixing device has two fixing parts, between which the bolt with its ends and the rail being supported are clamped by means of screws.

An embodiment that resists collapse has a fixing device that is a one-piece design. This embodiment provides that the fixing device is held in the fixing position by means of fasteners designed as screws and that in the fixing position, when seen in lengthwise direction of the rail, the slightly pre-tightened screws rest against the sides of the support element. This can be achieved with grub screws.

A preferred embodiment provides that a ball-shaped joint, such as a pivoting bearing, is located in the lower borehole of the tension element.

In an alternative embodiment, the fixing device has a frame-like fixing part, which can be fastened in a T-shaped groove of the rail being supported.

Additional features, details, and benefits of the invention will emerge from the subsidiary claims and the following description of sample embodiments by means of the drawing.

DESCRIPTION OF THE PREFERRED EMBODIMENTS

Figure 1:
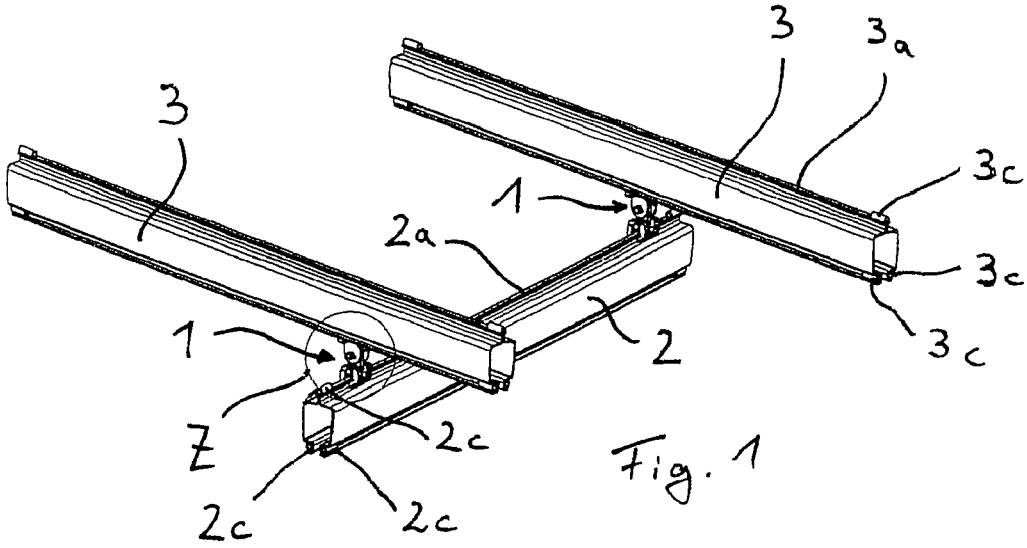
FIG. 1 is a perspective view of a single-beam overhead crane.
Figure 2:
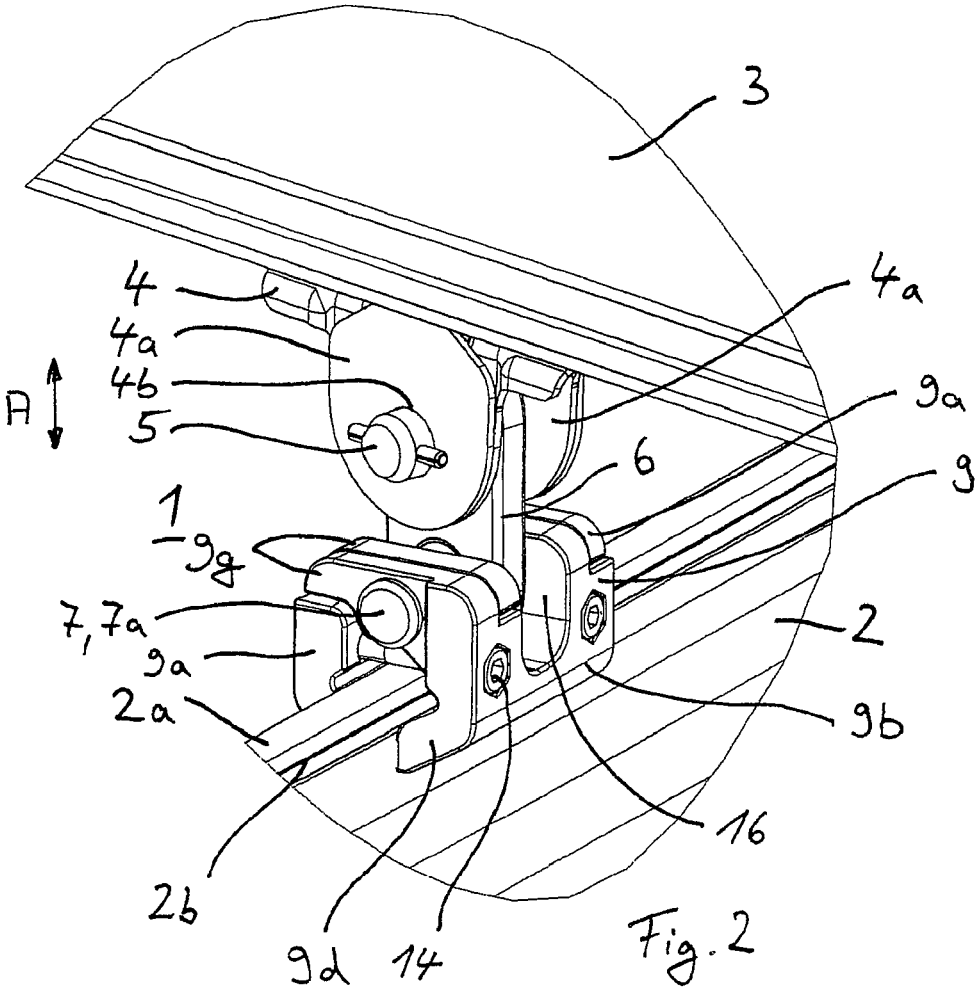
FIG. 2 is an enlarged view of the area Z in FIG. 1.

Referring to FIGS. 1 and 2, a single-beam overhead crane is shown with two suspensions 1, by which an essentially horizontal c-shaped rail 2, open at the bottom, is suspended from two essentially horizontal c-shaped travel rails 3, likewise open at the bottom, which are laid in parallel and at a distance from each other. The rail 2 travels essentially transverse to the travel rails 3 and can move along the travel rails 3.

For this, the rail 2 is suspended from a traversing gear 4 by the two suspensions 1 (see FIG. 2), which can travel in the travel rail 3 along its lengthwise direction by means of rollers (not shown). From the rail 2 is hung, in typical fashion, a hoisting machine (not shown), such as a chain or rope block, and it can move with an additional traversing gear along the rail 2. There are also provided additional suspensions 1 (not shown) along the travel rails 3, by which these are suspended from supporting structures, other rails, or traversing gears.

These suspensions 1 have pivoting bearings and thus have a pendulum type design, which ensures that the rail 2 and the travel rails 3 automatically orient themselves and thus come into a state of equilibrium, i.e., there is no significant bending load in the suspension 1, or in particular in the tension element 6 arranged in the suspension (see FIG. 2).

Thus, it is possible to grab the hoisting machine at the load or a suspended switch and move it along the rail 2 and the travel rail 3 without a special drive unit for this. When moving along the travel rail 3, it often happens, due to the flow of force off center—and depending on the particular position of the hoisting machine on the rail 2—that the rail 2 with the hoisting machine will become slanted relative to a position perpendicular to the travel rails 3. This slanted position is around 20 to 30 degrees. Normally, such a slanting would result in a seizing of the rail 2 or the traversing gears 4 on the travel rail 3. But since, as previously mentioned, the suspensions 1 are of a pendulum kind, when the travel rails 3 become crooked, they can simply reduce their mutual spacing and the traversing gears 4 can continue to travel unhindered in the travel rails 3. By pendulum suspension 1 is meant here that they enable a turning about a vertical axis and also a lateral tilting.

FIG. 2 shows a magnified feature of FIG. 1 from region Z, concerning the suspension 1. From this FIG. 2 one clearly sees that the traversing gear 4 has two brackets 4*a*, each with a bore 4*b*. The brackets 4*a*, parallel to each other and spaced apart, extend downward from the travel rail 3. Between the brackets 4*a* is arranged an upper end of a tension element 6 of the suspension 1. The tension element 6 is fashioned as a flat bracket in the manner of a connecting rod or a strip shape and is oriented roughly perpendicular to the lengthwise axis of the rail 2. This tension element 6 has an upper bore 10 and a lower bore 11 (see FIGS. 3, 8, and 10). The tension element 6 is suspended from the traversing gear by a bolt 5, which is passed through the bore 4*b* of the first bracket 4*a*, the upper bore 10 and the bore 4*b* of the second bracket 4*a*. The upper bore 10 has a knife-edge bearing, i.e., the bore 10 is crowned in configuration and the bolt 5 is guided point-like on the knife edge formed by the convexity with angular mobility. The lower bore 11 serves to suspend the rail 2 from the tension element 6. For this, a pivoting bearing 8 is installed in the lower bore 11 (see FIGS. 3, 7, 10), through whose bore 8*c* a further bolt 7 is passed. The ends 7*a*, 7*b* projecting beyond the tension element 6 and the pivoting bearing 8 in the respective lengthwise direction of the rail 2, engage with a fixing device 9, and are secure there in bores 13 without twisting. This fixing device 9 also encloses with form fitting an upper web 2*a* of the rail 2, which is y-shaped and broadens correspondingly toward the top, starting from the top side of the rail 2. Basically, a T-shaped or a different broadening configuration of the web 2*a* is also possible.

As an alternative, a pivoting bearing 8 can also be arranged in the upper bore 10.

Figure 3:
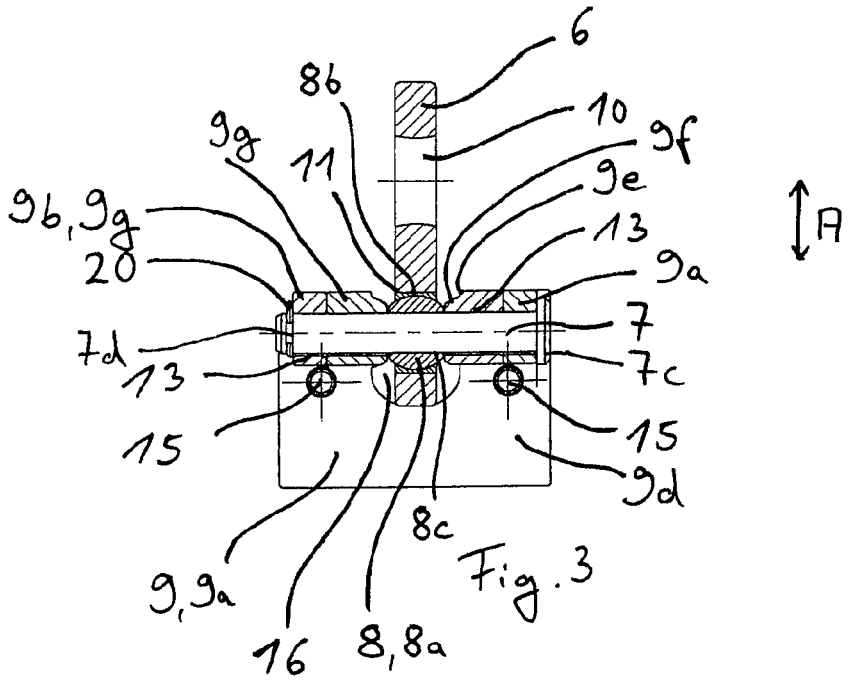
FIG. 3 is a front partial-sectional view of the suspension from FIG. 2.
Figure 4:
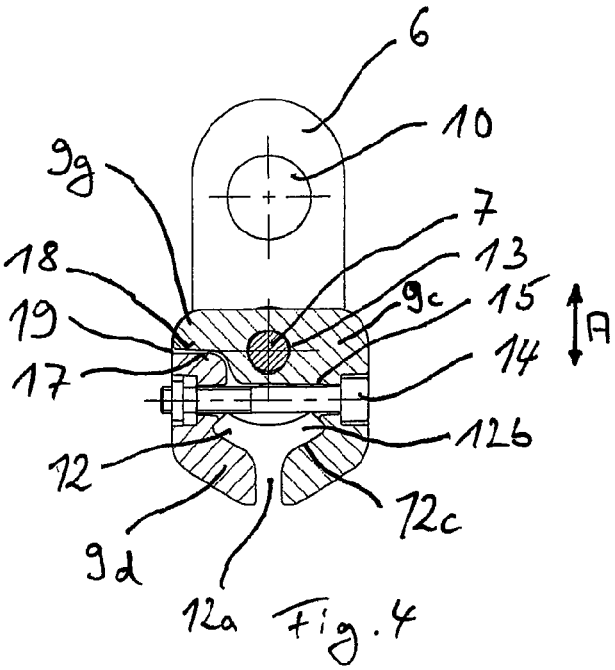
FIG. 4 is a partial-sectional side view of the suspension of FIG. 3 with fixing parts in the fixing position.
Figure 5:
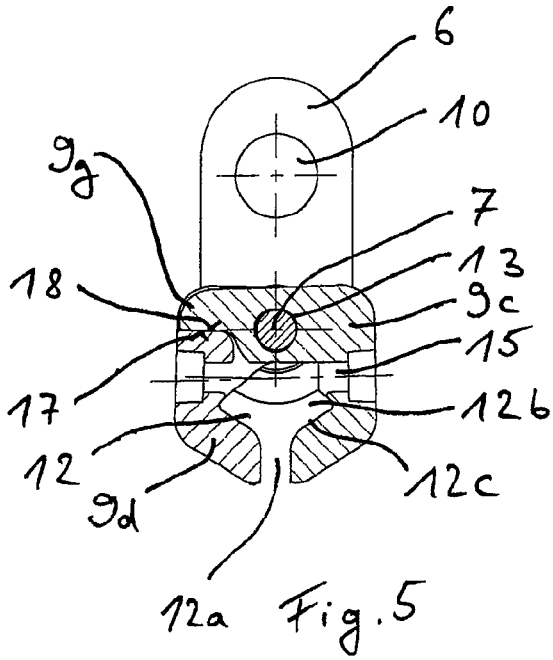
FIG. 5 is a partial-sectional side view of the suspension of FIG. 4 with fixing parts in the open position.
Figure 7:
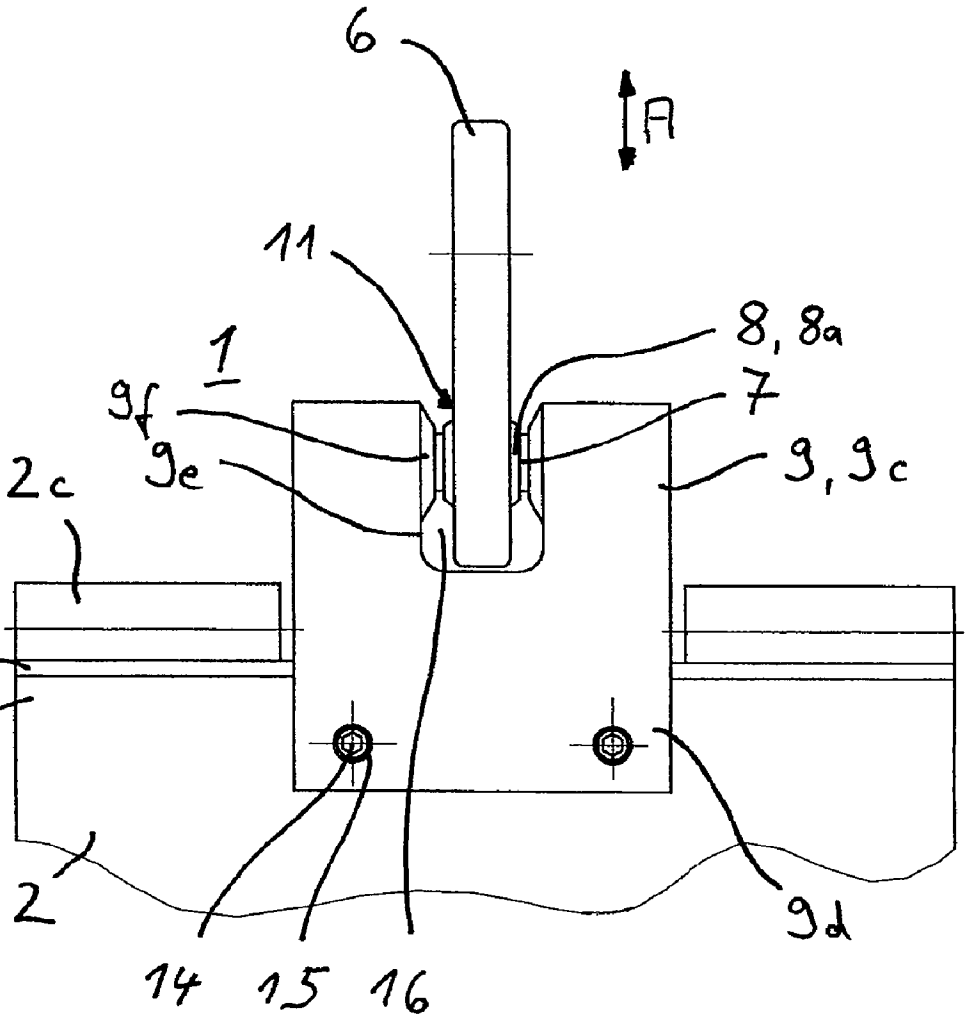
FIG. 7 is a front elevation of the suspension and rail segment of FIG. 6.
Figure 6:
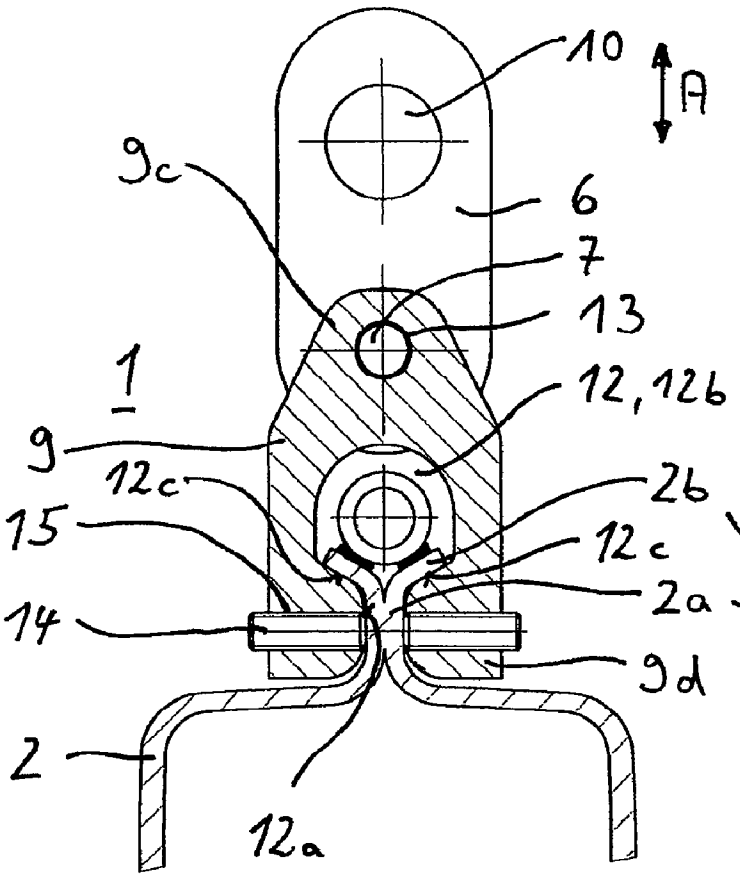
FIG. 6 is a partial-sectional side view of a rail segment with a suspension in a first alternative embodiment.
Figure 8:
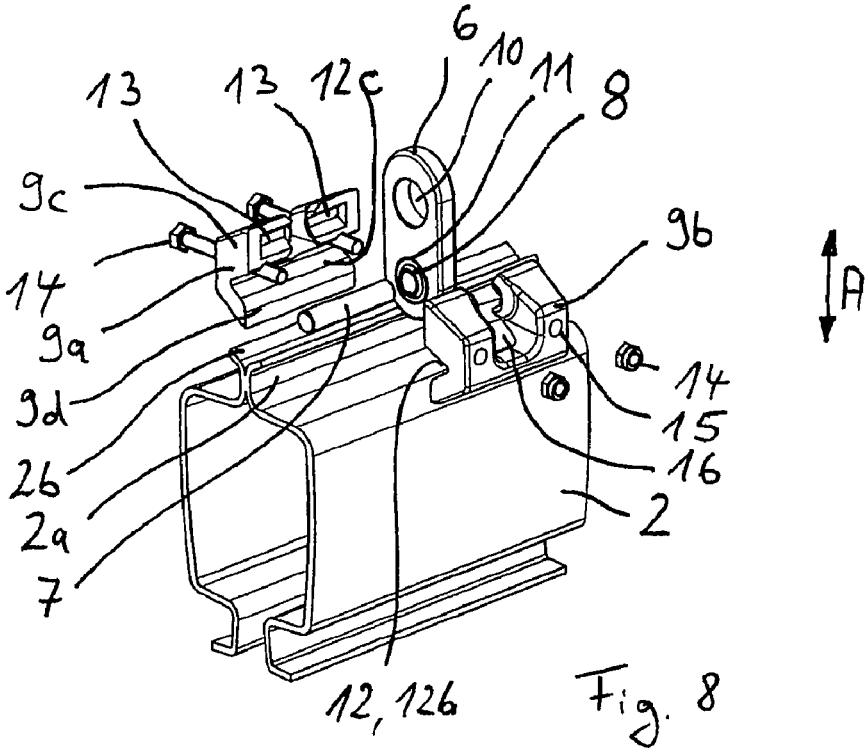
FIG. 8 is a perspective view of a rail segment with a suspension in a second alternative embodiment.
Figure 9:
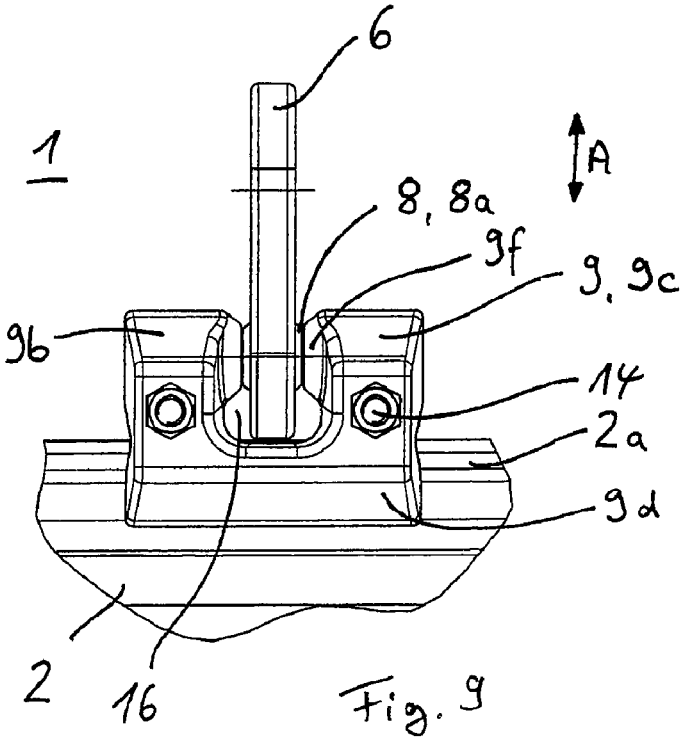
FIG. 9 is a front elevation of the suspension of FIG. 8.
Figure 10:
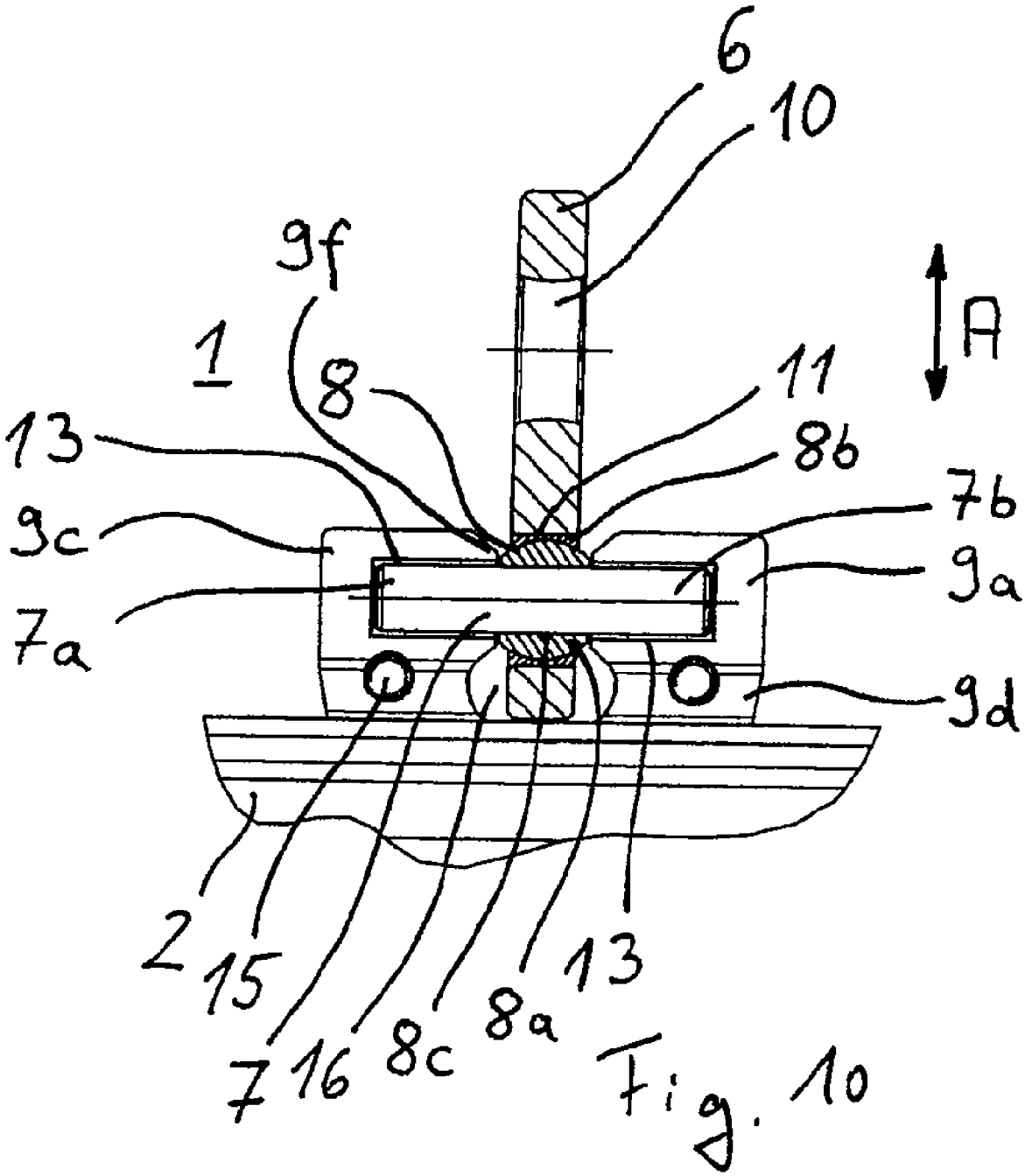
FIG. 10 is a partial-sectional front elevation of the suspension of FIG. 9.

FIGS. 3 to 5 show in detail the suspension 1 for the rail 2, especially its fixing device 9, in a first embodiment, FIGS. 6 and 7 in a second embodiment, and FIGS. 8 to 10 in a third embodiment. Supplementing the description given for FIG. 2, one will recognize that a pivoting bearing 8 is arranged in the lower bore 11 of the tension element 6, through which the bolt 7 passes. The pivoting bearing 8 is a customary, off the shelf, standardized and industrially manufactured radial pivoting bearing, for example, one per DIN ISO 12240, having an outer race 8*b*, in which an inner race 8*a* is mounted. The inner race 8*a* has a cylindrical bore 8*c* for receiving the bolt 7 without twisting, and a spherical outer slide track to form the ball head. This outer slide track engages with a hollow inner slide track of the outer race 8*b*, which is installed by its cylindrical envelope surface in the bore 11 free of twisting. Between the inner race 8*a* and the outer race 8*b* is arranged a slide ring (not shown), for example, made of plastic or PTFE. This slide ring is then fastened to the outer race 8*b* and the inner race 8*a* slides in the slide ring. The bolt 7 is oriented parallel to the lengthwise direction of the rail 2. Thus, the tension element 6 can swivel sideways to the right and left about the bolt 7, relative to the fixing device 9 and looking in the lengthwise direction of the rail 2, and it can also turn through around ±15°, looking in the lengthwise direction of the tension element 6. An additional ±15° swiveling capability occurs between tension element 6 and bolt 5 at the knife-edge bearing in the bore 10.

In the event that the inner race 8*a* and the outer race 8*b* are made of steel and are in direct contact, a supply of lubricant is also usually provided. In a different design, the outer ring 8*b* can be omitted as a separate part and its function is taken over by the tension element 6. The inner race 8*a* is introduced transversely into the widened bore 11 in the tension element 6 and turned through 90 degrees in the bore 11 into its working position. After this, the widening of the bore 11 and the gap between inner race 8*a* and bore 11 is filled with a plastic, which hardens to form the slide ring.

FIGS. 3 to 5 show a first embodiment of the fixing device 9, which essentially consists of two identical fixing parts 9*a* and 9*b*. The two fixing parts 9*a* and 9*b* are fastened together and can swivel, limited by the bolt 7 for suspension from the tension element 6, from an open position to a fixing position. FIG. 4 shows the fixing position and FIG. 5 the open position. In both positions and any intermediate positions, the fixing parts 9*a*, 9*b* have a c-shaped cross section open at the bottom, which bounds an upwardly broadening, mushroom-shaped lengthwise opening 12, looking in the lengthwise direction of the rail 2. In terms of function, the fixing parts 9*a*, 9*b* can be divided into an upper suspension region 9*c* and a lower fixing region 9*d*. This lengthwise opening 12, which is bounded by the fixing region 9*d* of the fixing parts 9*a*, 9*b* of the fixing device 9, has a lower gap region 12*a* and, above it, an opening region 12*b*. Thus, looking in the lengthwise direction of the rail 2, the fixing region 9*d* has the shape of two opposite fixing arms or gripping arms, spaced apart and bent inward at their lower free end. The gripping arms are bent toward each other, terminate in the gap region 12*a*, and thus diminish the opening region 12*b*. In the opening region 12*b*, the fixing region 9*d* has flat bearing surfaces 12*c*, slanting upward and starting from the gap region 12*a*. These bearing surfaces 12*c* serve for a two-dimensional accommodation of the ends 2*b* of the y-shaped web 2*a*, broadening outwardly in opposite directions. Thus, these bearing surfaces 12*c* take up the load of the rail 2 and the load suspended from or being carried thereon, regardless of whether the fixing device 9 is in the open or fixing position.

The fixing parts 9*a*, 9*b* with limited angular mobility around the bolt 7 form a kind of pincer mechanism to restrain the rail 2. However, the special feature of the fixing parts 9*a*, 9*b* is that their angular mobility is limited such that, even in the open position, the ends 2*b* of the web 2*a* cannot slip down from the lengthwise opening 12 of the fixing device 9 and are thus firmly restrained.

The fixing device 9 of the suspension 1 in the first embodiment, especially its fixing parts 9*a* and 9*b*, has an intermediate space 16 open at the top, running transversely and horizontally when viewed in the lengthwise direction of the rail 2, being bounded by a u-shaped fixing device 9, especially its web-like suspension regions 9*c*. On the inner sides 9*e* of the suspension regions 9*c* of the fixing device 9, which face each other, there are arranged flat conical projections 9*f*. The bores 13 of the suspension regions 9*c* of the fixing device 9 for the bolt 7 are continued centrally in these projections 9*f*. Because of the projections 9*f*, the intermediate space 16 is narrowed and resting surfaces are created for the pivoting bearing 8.

Moreover, this intermediate space 16 divides the pivoting connection of the two fixing parts 9*a*, 9*b* into a first and a second hinge-like pivot region. Each of these pivot regions has an arm 9*g* of the fixing region 9*d* of the particular fixing part 9*a*, 9*b*. Each of the arms 9*g* receives a portion of the bore 13 for the bolt 7, looking roughly down the center in the lengthwise direction of the rail 2. The arrangement of the arms 9*g*, the bolt 7 and the bore 13 is comparable to a multiple-section bolt connection.

In order to accomplish the aforementioned limiting of the angular mobility of the fixing parts 9*a* and 9*b*, bearing surfaces 17 are formed on the one fixing part 9*a* and mating surfaces 18 on the other fixing part 9*b*. The mating surfaces 18 are arranged on the lower sides of the free ends of the arms 9*g* and are basically oriented horizontally. The bearing surfaces 17 are situated at the side next to the beginning of the arm 9*g* on the fixing part 9*a*, 9*b*, which is opposite the free end, and thus they lie opposite each other in relation to the bolt 7.

In the open position of the fixing parts 9*a* and 9*b*, the bearing surfaces 17 and mating surfaces 18, which are arranged like the clamping jaws of pliers in relation to each other, come to bear against each other. In the fixing position, the bearing surfaces 17 are separated from the mating surfaces 18 by a gap 19. However, the bearing surfaces 17 and the mating surfaces 18 do not prevent a closing movement, i.e., a bearing in the manner of a pliers against the webs 2*a* between the gripping levers of a pair.

In order to be able to secure the fixing device 9 at a desired position in the lengthwise direction after it is shoved onto the web 2*a* or put together around the web 2*a*, there are two screws 14 provided. The screws 14 pass through the fixing parts 9*a*, 9*b* at such a height that they do not interfere with the web 2*a* and they cross through the opening region 12*b* of the lengthwise opening 12 beneath the arms 9*g*. By means of the screws 14, the fixing parts 9*a*, 9*b* can be moved about the bolt 7 and swiveled from the open position to the fixing position against each other, until the ends of the gripping arm regions 9*d* come to bear against the web 2*a*. It should be stressed once more that this clamping serves mainly to secure the fixing device 9 in the lengthwise direction of the rail 2 and has basically no fixing or supporting function.

Accordingly, the size, especially the height of the opening region 12*b* of the lengthwise opening 12, is chosen so that the screws 14 have sufficient room to cross the lengthwise opening 12 beneath the bolt 7 and above the web 2*a*. However, the height of the lengthwise opening 12 is not enough to shove the fixing device 9 in the assembled condition from one end of the rail 2 onto its web 2*a* in the lengthwise direction of the rail 2, which runs essentially horizontally. Such a movement is prevented because cylindrical connection sleeves 2*c* are arranged on the web 2*a* in the upper opening of the web 2*a* at the start and end of the rail 2. These connection sleeves 2*c* serve to join the ends of two rails 2 in butt fashion. Additional connection sleeves 2*c* are located at the c-shaped lower ends of the rail 2 (see FIG. 1). These connection sleeves 2*c*, which lie opposite each other at the butt end of two rails 2, can then easily be joined by screws and at the same time they will align the rails 2 with each other.

Thus, the fixing device 9 must be put together at the desired suspension point on the rail 2. For this, the two fixing parts 9*a*, 9*b* are joined together without the bolt 7 and the screws 14 at the desired suspension point on the rail 2 so that the bores 13 are aligned and the web 2*a* of the rail 2 is grasped by the fixing regions 9*d* of the fixing device 9. Then the bolt 7 is inserted in the lengthwise direction of the rail 2 into the bore 13 from one side, so that it passes through the part of the bore 13 of the first two arms 9*g* of the fixing parts 9*a*, 9*b*. Now, the tension element 6 with its pivoting bearing 8 is inserted into the intermediate space 16 and lined up with the bore 13. The bolt 7 is shoved further through the pivoting bearing 8 and the remainder of the bore 13 into the two second arms 9*g* of the fixing parts 9*a*, 9*b* until the head 7*c* of the bolt 7 comes to rest against the fixing device 9. At the other side, the other end 7*a* of the bolt 7 sticks out from the bore 13. To secure the bolt 7 in the bore 13, a circumferential groove 7*d* is provided at the end 7*a* of the bolt 7 sticking out, into which a snap ring 20 is inserted from the side, coming to bear against the other end of the fixing device 9.

Since the travel rails 3 have a cross section identical to the rail 2, one also finds there the above-described web 3*a* and the three connection sleeves 3*c* at the ends of the travel rails 3 (see FIG. 1).

In an alternative embodiment of the fixing device 9, not drawn, the height of the opening region 12*b* and the size of the gap region 12*a* of the lengthwise opening 12 in the open position or the spacing of the arm-like fixing regions 9*d* of the fixing device 9 are chosen such that the fixing device 9 can be shoved onto the web 2*a* of the rail 2 from one end in the lengthwise direction of the rail 2, which runs essentially horizontally. The lengthwise opening 12, especially its opening region 12*b*, starting from the gap region 12*a*, is then provided with a sufficient height to allow the web 2*a* as well as the connection sleeves 2*c* to pass.

FIGS. 6 and 7 show a first alternative embodiment of the fixing device 9. As compared to the fixing device 9 previously described, this one is a single-piece design, i.e., only one part 9*a* is present, nor is there a limited swiveling capacity of the parts 9*a* and 9*b* relative to each other. Looking in the lengthwise direction of the rail 2, once again there is a c-shaped cross section, open at the bottom, bounding a mushroom-shaped and upward broadening lengthwise opening 12 extending in the lengthwise direction of the rail 2. In terms of function, the part 9*a* can be divided into an upper suspension region 9*c* and a lower fixing region 9*d*. The lengthwise opening 12, which is bounded by the fixing region 9*d* of the part 9*a* of the fixing device 9, has a lower gap region 12*a* and, adjoining this at the top, an opening region 12*b*. The fixing region 9*d* thus has the shape, looking in the lengthwise direction of the rail 2, of two fixing arms or gripping arms facing each other, separated by the lengthwise opening 12 and bent inward at their free ends. The gripping arms are bent toward each other, terminate in the gap region 12*a*, and thus narrow the opening region 12*b*. In the opening region 12*b*, the fixing region 9*d* has flat, upwardly slanting bearing surfaces 12*c*, starting from the gap region 12*a*. These bearing surfaces 12*c* provide a two-dimensional seat for the ends 2*b* of the y-shaped web 2*a*, which move away from each other in the upward direction. Thus, these bearing surfaces 12*c* absorb the load of the rail 2 and the load being conveyed or suspended from it.

The size of the lengthwise opening 12 or the spacing between the arm-like fixing regions 9*d* of the fixing device 9 is chosen such that the fixing device 9 runs essentially horizontally in the lengthwise direction of the rail 2 and can be shoved onto the web 2*a* of the rail 2 from one end. The design of the fixing device 9 with the fixing regions 9*d* enclosing the web 2*a* in c-shaped manner ensures that the web 2*a* of a horizontally oriented rail 2, looking in the vertical direction, cannot slip downward from the fixing device 9 and thus the rail 2 is held firmly. Furthermore, the size of the lengthwise opening 12, especially its opening region 12*b*, starting from the gap region 12*a*, has sufficient height to allow both the web 2*a* and the cylindrical connection sleeves 2*c*, arranged in the upper opening of the web 2*a* at the start and end of the rail 2, to pass.

In order to secure the fixing device 9 in a desired position after shoving it onto the web 2*a* in the lengthwise direction of the rail 2, there are four screws 14. The screws 14 are configured as grub screws, being screwed into bores 15, configured as threaded bores, running essentially horizontally and transversely to the lengthwise direction of the rail 2, and bearing with their tip against or being lightly screwed into the narrow segment of the web 2*a*, i.e., the region of the gap region 12*a* of the lengthwise opening 12. It should be stressed yet again that these screws 14 basically serve only to secure the fixing device 9 in the lengthwise direction of the rail 2 and do not take on any support function.

The fixing device 9 of the first alternative suspension 1 also has an intermediate space 16 open at the top, looking transversely and horizontally to the lengthwise direction of the rail, being bounded by a u-shaped fixing device 9, especially its web-like suspension regions 9*c*. On the inner sides 9*e* of the suspension regions 9*c* of the fixing device 9, which face each other, there are arranged flat conical projections 9*f*. The bores 13 of the suspension regions 9*c* of the fixing device 9 for the bolt 7 are continued centrally in these projections 9*f*. Because of the projections 9*f*, the intermediate space 16 is narrowed and resting surfaces are created for the pivoting bearing 8.

In regard to the configuration of the pivoting bearing 8, reference is made to the description for FIGS. 3 to 5.

FIGS. 8 to 10 show a second alternative embodiment of the fixing device 9. Compared to the previously described fixing devices 9, this one consists of two identical fixing parts 9*a*, 9*b*, which are joined by screws 14 to clamp against the rail 2. In the state of the fixing parts 9*a*, 9*b* tightened together by the screws 14, once again there is a c-shaped cross section open at the bottom, looking in the lengthwise direction of the rail 2, bounding a mushroom-shaped and upward broadening lengthwise opening 12 extending in the lengthwise direction of the rail 2. In terms of function, the part 9*a* can be divided into an upper suspension region 9*c* and a lower fixing region 9*d*. This lengthwise opening 12, which is bounded by the fixing region 9*d* of the part 9*a* of the fixing device 9, has a lower gap region 12*a* and, adjoining this at the top, an opening region 12*b*. The fixing region 9*d* thus has the shape, looking in the lengthwise direction of the rail 2, of two fixing arms or gripping arms facing each other, separated by the lengthwise opening 12 and bent inward at their free lower ends. The gripping arms are bent toward each other, terminate in the gap region 12*a*, and thus narrow the opening region 12*b*. In the opening region 12*b*, the fixing region 9*d* has flat, upwardly slanting bearing surfaces 12*c*, starting from the gap region 12*a*. These bearing surfaces 12*c* provide a two-dimensional seat for the ends 2*b* of the y-shaped web 2*a*, which move away from each other in the upward direction. Thus, these bearing surfaces 12*c* absorb the load of the rail 2 and the load being conveyed or suspended from it.

The height of the opening region 12*b* of the lengthwise opening 12 is chosen so that the screws 14 have sufficient room to cross the lengthwise opening 12 beneath the bolt 7 and above the web 2*a*. However, the height of the lengthwise opening 12 is not enough to shove the fixing device 9 in the assembled condition from one end of the rail 2 onto its web 2*a* in the lengthwise direction of the rail 2, which runs essentially horizontally. Such a movement is prevented because cylindrical connection sleeves 2*c* are arranged on the web 2*a* in the upper opening of the web 2*a* at the start and end of the rail 2. These connection sleeves 2*c* serve to join the ends of two rails 2 in abutting fashion. Additional connection sleeves 2*c* are located at the c-shaped lower ends of the rail 2 (see FIG. 1). These connection sleeves 2*c*, which lie opposite each other at the butt end of two rails 2, can then easily be joined by screws and at the same time they will align the rails 2 with each other.

Thus, the fixing device 9 must be put together at the desired suspension point on the rail 2. For this, the two fixing parts 9*a*, 9*b* are joined together at the desired suspension point on the rail 2 so that the bores 13, which are configured here as blind holes, enclose the bolt 7 and the web 2*a* of the rail 2 is grasped by the fixing regions 9*d* of the fixing device 9. The fixing parts 9*a*, 9*b* are then joined together by the screws 14. Thanks to the screws 14, the bolt 7 is held clamped and without twisting in the bores 13 of the fixing parts 9*a*, 9*b*. The screws 14 also press the fixing regions 9*d* of the fixing parts 9*a*, 9*b* sideways against the web 2*a* of the rail 2, so that the fixing device 9 is secured in a desired spot in the lengthwise direction of the rail 2.

The fixing device 9 of the second alternative suspension 1 also has an intermediate space 16 open at the top, looking transversely and horizontally to the lengthwise direction of the rail, being bounded by a u-shaped fixing device 9, especially its web-like suspension regions 9*c*. On the inner sides 9*e* of the suspension regions 9*c* of the fixing device 9, which face each other, there are arranged flat conical projections 9*f*. The bores 13 of the suspension regions 9*c* of the fixing device 9 for the bolt 7 are continued centrally in these projections 9*f*. Because of the projections 9*f*, the intermediate space 16 is narrowed and resting surfaces are created for the pivoting bearing 8, especially its inner ring 8*a*.

In regard to the configuration of the pivoting bearing 8, reference is made to the description for FIGS. 3 to 5.

Figure 11:
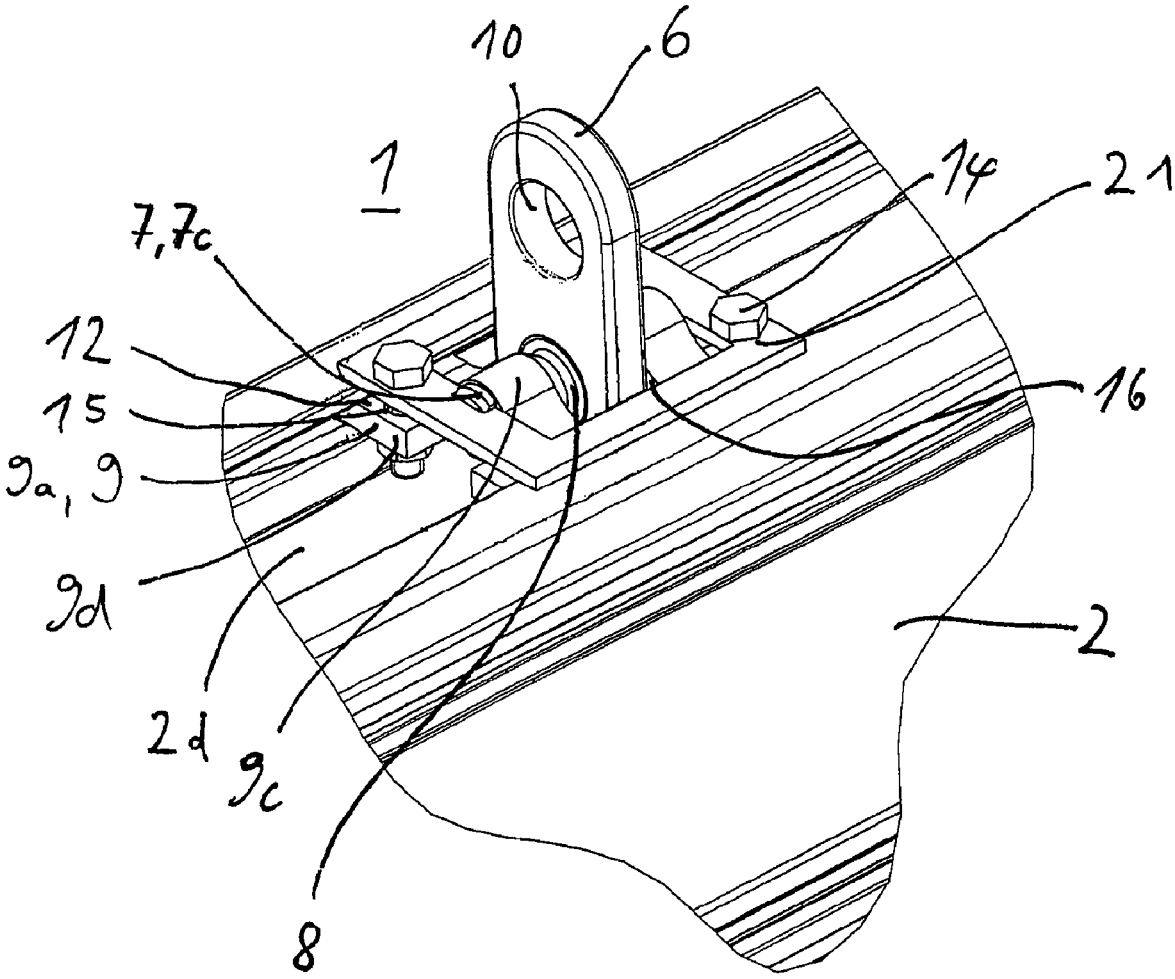
FIG. 11 is a perspective view of a rail segment with a suspension in a third alternative embodiment.
Figure 12:
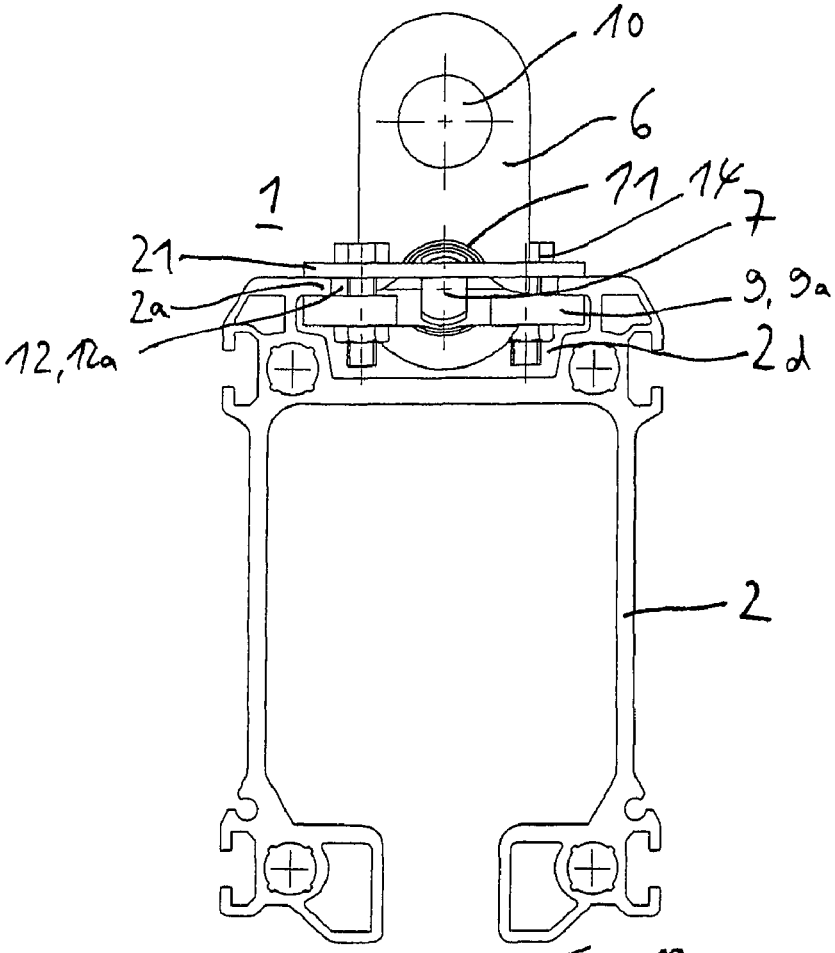
FIG. 12 is a side elevation of the suspension of FIG. 11.
Figure 13:
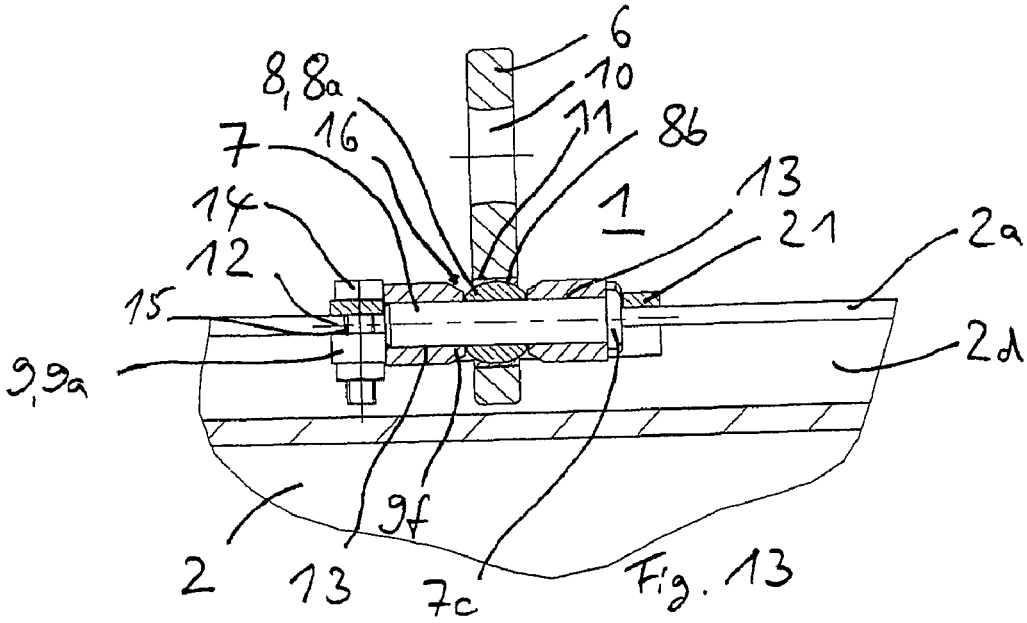
FIG. 13 is a sectional view of the suspension of FIG. 12.

FIGS. 11 to 13 show a third alternative embodiment of the fixing device 9. As compared to the previously described fixing devices 9, this one is suitable for a different type, a c-shaped rail 2 open at the bottom, which can preferably be made of aluminum. This rail 2, instead of having the ends 2*b* of the y-shaped web 2*a* moving away from each other, has a T-shaped groove 2*d* at the upper side of the rail 2, narrowing toward the fixing device 9. Accordingly, this fixing device 9 is adapted to this type of rail 2.

The fixing device 9 consists of a frame-like fixing part 9*a*, which is shoved into the T-shaped groove 2*d* from one end or, alternatively, when so configured as in the manner of a tenon block, it is inserted from above into the T-shaped groove 2*d* and then turned through 90 degrees, so that the fixing part 9*a* engages in part beneath the upper webs 2*a* of the groove 2*d*. In order to secure the fixing part 9*a* at a desired spot in the lengthwise direction of the rail 2, the fixing part 9*a* is pulled upward by screws 14 and thus thrusts against the bottom of the web 2*a* of the T-shaped groove 2*d*. The screws 14 thrust against the top of the web 2*a* of the T-shaped groove 2*d*. Thus, the fixing device 9 is clamped firmly on the web 2*a*. If the screws 14 should, fail, the fixing part 9*a* still remains fixed in the T-shaped groove 2*d*. In order to transfer more safely the clamping forces of the screws 14 to the top of the web 2*a* of the T-shaped groove 2*d* or the top of the rail 2*a*, a rectangular frame-like abutment 21 is provided, being arranged above the bores 15 in the fixing part 9*a* for the screws 14 and extending from here across the top of the web 2*a* of the T-shaped groove 2*d* and the top of the rail 2*a*. Two screws 14 engage with the fixing part 9*a* at diagonally opposite corners. To receive the bores 15 for the screws 14, the frame-like fixing part 9*a* is extended by a bracket region for each one. Also, a lengthwise opening 12 running in the lengthwise direction of the rail 2 with a gap region 12*a*, serving to receive the web 2*a* of the rail 2, is enclosed between the abutment 21 and the first fixing part 9*a* by their margin regions.

This fixing device 9 can also be divided into the previously described fixing region 9*d* and the adjoining suspension region 9*c*. The suspension region 9*c* essentially consists of two bores 13 to receive the bolt 7, being separated by an intermediate space 16, in which the pivoting bearing 8 with the tension element 6 is recessed. The intermediate space 16 also has projections 9*f* protruding into it, in order to center the pivoting bearing. The bolt 7 extending through the two bores 13 and the pivoting bearing 8 has a head 7*c* at one end, which is held without twisting by a recess in the abutment 21 and held in the bore 13. In the region of the bores 13, the otherwise flat fixing part 9*a* is thickened vertically in the manner of pillow blocks. These pillow blocks extend upward from the T-shaped groove 2*d*.

In regard to the configuration of the pivoting bearing 8, refer to the description for FIGS. 3 to 5.

Also, the aforementioned sample embodiment describes a preferred use of the suspension 1 with single-beam overhead cranes, namely, between the rail 2 and the travel rail 3. This new suspension 1 is also suitable for suspending the travel rails 3 from suitable support structures or other rails 2. The rail 2 can also be I-shaped.

LIST OF REFERENCE NUMBERS

1 suspension
2 rail
2*a* web
2*b* web end
2*c* connection sleeves
2*d* T-shaped groove
3 travel rail
3*a* web
3*c* connection sleeves
4 traversing gear
4*a* bracket
4*b* bore
5 bolt
6 tension element
7 bolt
7*a* bolt end
7*b* bolt end
7*c* bolt head
7*d* groove
8 pivoting bearing
8*a* inner race
8*b* outer race
8*c* bore
9 fixing device
9*a* fixing part
9*b* fixing part
9*c* suspension region
9*d* fixing region
9*e* inner sides
9*f* projection
9*g* arm
10 upper bore
11 lower bore
12 lengthwise opening
12*a* gap region
12*b* opening region
12*c* bearing surface
13 bore
14 screws
15 bore
16 intermediate space
17 bearing surface
18 mating surface
19 gap
20 snap ring
21 abutment
A direction of suspension
Z region

The invention claimed is:

1. A device for suspending a rail from a supporting structure, said device comprising:

a fixing device, said fixing device being coupled to a rail;

a generally vertically extending tension element, said tension element being unitarily formed and defining a lower borehole and an upper borehole, wherein said tension element is coupled to the rail via said fixing device at said lower borehole, and wherein said tension element is coupled to the supporting structure at said upper borehole wherein said tension element suspends the rail from the supporting structure;

a bolt, said bolt being received at said lower borehole of said tension element and at said fixing device to couple said tension element to said fixing device; and a ball-shaped joint, said ball-shaped joint adapted to couple said bolt to said tension element.

2. The device according to claim 1, wherein said tension element comprises a connection rod-shaped bracket.

3. The device according to claim 2, wherein said bolt and said tension element are at least partly recessed into said fixing device.

4. The device according to claim 2, wherein said bolt is completely recessed into said fixing device.

5. The device according to claim 2, wherein said fixing device defines an intermediate space, whereby said fixing device comprises a U-shaped form open at the top, wherein at least one of said tension element and said bolt protrudes into said intermediate space, and wherein said bolt is oriented with its lengthwise dimension parallel to the lengthwise direction of the rail.

6. The device according to claim 1, wherein said bolt and said tension element are at least partly recessed into said fixing device.

7. The device according to claim 6, wherein said bolt is completely recessed into said fixing device.

8. The device according to claim 7, wherein said fixing device defines an intermediate space, whereby said fixing device comprises a U-shaped form open at the top, wherein at least one of said tension element and said bolt protrudes into said intermediate space, and wherein said bolt is oriented with its lengthwise dimension parallel to the lengthwise direction of the rail.

9. The device according to claim 6, wherein said bolt is completely recessed into said fixing device.

10. The device according to claim 6, wherein said fixing device defines an intermediate space, whereby said fixing device comprises a U-shaped form open at the top, wherein at least one of said tension element and said bolt protrudes into said intermediate space, and wherein said bolt is oriented with its lengthwise dimension parallel to the lengthwise direction of the rail.

11. The device according to claim 1, wherein said fixing device defines an intermediate space, whereby said fixing device comprises a u-shaped form open at the top, wherein at least one of said tension element and said bolt protrudes into said intermediate space, and wherein said bolt is oriented with its lengthwise dimension parallel to the lengthwise direction of the rail.

12. The device according to claim 1, wherein said fixing device comprises bores adapted to receive said bolt and said bolt comprises opposite ends, and wherein said bolt is held free of torsion in said bores of said fixing device by said ends, with both of said ends of said bolt protruding from said ball-shaped joint.

13. The device according to claim 1, wherein said fixing device comprises two fixing parts, and wherein said bolt and the rail are clamped between said two fixing parts of said fixing device by means of screws.

14. The device according to claim 1, wherein said fixing device is unitarily formed.

15. The device according to claim 14 wherein said fixing device is held in a fixing position via fasteners oriented crosswise to said support such that when said fasteners are at least partly pre-tightened, said fasteners contact the sides of the supporting structure.

16. The device according to claim 15, wherein said fasteners comprise screws.

17. The device according to claim 1, wherein said ball-shaped joint is located in said lower borehole of said tension element.

18. The device according to claim 17, wherein said ball-shaped joint comprises a pivoting bearing.

19. The device according to claim 1, wherein said fixing device comprises a C-shaped fixing part, said C-shaped fixing part being configured to be fastened in a T-shaped groove of the rail.

20. The device according to claim 1, wherein said ball-shaped joint comprises a pivoting bearing.

* * * * *